US011414861B2

(12) United States Patent
Savushkin et al.

(10) Patent No.: US 11,414,861 B2
(45) Date of Patent: Aug. 16, 2022

(54) BUILDING BLOCK AND METHOD FOR ASSEMBLING BUILDING BLOCKS

(71) Applicant: DOMIDO LIMITED, Nicosia (CY)

(72) Inventors: Roman Aleksandrovich Savushkin, Moscow (RU); Alexey Mihailovich Sokolov, Saint-Petersburg (RU)

( * ) Notice: Subject to any disclaimer, the term of this patent is extended or adjusted under 35 U.S.C. 154(b) by 89 days.

(21) Appl. No.: 16/645,663

(22) PCT Filed: Aug. 21, 2018

(86) PCT No.: PCT/RU2018/000549
§ 371 (c)(1),
(2) Date: Mar. 9, 2020

(87) PCT Pub. No.: WO2019/050432
PCT Pub. Date: Mar. 14, 2019

(65) Prior Publication Data

US 2020/0277783 A1 Sep. 3, 2020

(30) Foreign Application Priority Data

Sep. 7, 2017 (RU) ..... RU2017131439

(51) Int. Cl.
*E04B 2/18* (2006.01)
*E04B 2/08* (2006.01)
(Continued)

(52) U.S. Cl.
CPC ..... *E04B 2/18* (2013.01); *E04B 2/08* (2013.01); *E04C 1/00* (2013.01); *E04B 2002/0219* (2013.01); *E04B 2002/0232* (2013.01)

(58) Field of Classification Search
CPC ..... E04B 2/18; E04B 2/08; E04B 2002/0219; E04B 2002/0232; E04B 2002/0247; E04C 1/00
(Continued)

(56) References Cited

U.S. PATENT DOCUMENTS 3,435,576 A * 4/1969 Giannelia ..... E04B 2/12 D25/113
4,441,298 A * 4/1984 Limousin ..... A63H 33/088 52/592.2

(Continued)

*Primary Examiner* — Brian E Glessner
*Assistant Examiner* — Adam G Barlow
(74) *Attorney, Agent, or Firm* — Anna Vishev

(57) ABSTRACT

This invention relates to the building art, and more particularly to blocks for the construction of buildings, structures, and hardscaping items, and to a method for assembling building blocks without using mortar. A building block, configured as a parallelepiped, comprises three pairs of opposing faces, including four lateral faces and two faces constituting an upper and a lower bases, each of the faces including a plurality of elements constituting projections and recesses, wherein each of the elements is shaped as a regular pyramid with rounded edges, and the pyramid vertex angle between two opposing faces is within the range from 90 to 179.9 degrees. The projections and recesses are arranged in rows and columns, wherein the pyramid bases at each of the parallelepiped faces are arranged in a single plane which is a face of the parallelepiped, and the respective sides of the pyramid bases are parallel to the parallelepiped faces, wherein the sides of the base of a pyramid that constitutes a projection are adjacent to the respective sides of the bases of adjoining pyramids that constitute the recesses. Projections and recesses at the block faces enable coupling of four blocks, three of which having paired adjacent faces that are perpendicular to each other and in contact at the edges. Also
(Continued)

described are various embodiments of the block and of a method for assembling building blocks.

33 Claims, 12 Drawing Sheets

(51) Int. Cl.
*E04C 1/00* (2006.01)
*E04B 2/02* (2006.01)

(58) Field of Classification Search
USPC ..... 52/596, 574, 604
See application file for complete search history.

(56) References Cited

U.S. PATENT DOCUMENTS 5,617,691 A * 4/1997 Yamamoto ..... G21F 3/04 52/603
5,666,777 A * 9/1997 Murphy ..... E04B 2/08 52/424
6,168,354 B1 * 1/2001 Martin ..... E02D 29/025 405/286
6,942,420 B1 * 9/2005 Drost ..... E01C 11/225 52/603
2021/0156147 A1 * 5/2021 Fermanian ..... E04C 1/41

* cited by examiner

BUILDING BLOCK AND METHOD FOR ASSEMBLING BUILDING BLOCKS

TECHNICAL FIELD

This invention relates to the building art, and more particularly to blocks for the construction of buildings, structures, and hardscaping items, and to a method for assembling building blocks.

The invention may be used for mortarless masonry laying.

BACKGROUND OF THE INVENTION

The use of traditional building blocks, bricks, mortars, and structures presents some well-known limitations. First, it is the need for skilled labor to produce high-quality masonry and to achieve a uniform, repeatable result.

The use of mortar construction also presents limitations in the speed at which a structure can be erected due to the requirement for mortar to cure, and limitations in the compressive load carrying ability of the structure due to the variation in stiffness between building blocks and mortar.

The use of pre-cast concrete panels has become more common, specifically, in an attempt to ameliorate some of these limitations. The use of such panels has its own limitations and deficiencies, including: the needs to use special-purpose equipment to deliver the panels, to use hoisting cranes during loading, unloading and installation of the panels, and the need for skilled labor.

As an alternative to traditional building block and brick-and-mortar constructions, interlocking building blocks have been used.

One example of such block is shown in U.S. Pat. No. 3,888,060 A.

These blocks are designed to be assembled in longitudinally staggered rows. The blocks are planar on their bottom side and include webs with interlocking protrusions on their upper side. The protrusions coact with the webs on adjacent rows of blocks to locate and hold the blocks in position. Corner blocks and end blocks are also provided so that a series of walls may be constructed without the need for the usual mortared joints. The protrusions are chamfered and have associated therewith an excess material-receiving groove to compensate for manufacturing tolerances. A completed wall may be grouted through interconnecting cavities in the hollow blocks to provide additional strength.

Said building blocks are deficient in several respects: specifically, another block configuration has to be used for laying wall corners; the blocks do not allow for attaching newly built walls to existing walls; special end blocks are required to build a wall, and, finally, no bonding is provided between the block side surfaces.

Another known building brick has upper and lower faces (ref., for example, to U.S. Pat. No. 4,124,961 A).

The upper face of said brick has a pair of longitudinally extending triangular ridges along each side thereof, each ridge having a narrow flat apex surface. The lower face has a pair of complementary depressions formed by a central longitudinally extending upstanding portion of height less than the height of the ridges, so that when similar bricks are engaged, their depressions and ridges interlock to align their viewable faces and restrain movement of the bricks in a transverse direction, while leaving a space at least 0.3 cm thick and of width equal to at least 40 percent of the width of each brick, between successive rows of bricks to contain bonding material, and with the upper brick resting on the apex surfaces of the brick beneath it. A similar vertical space is provided between the end faces of the bricks, so that a wall can be assembled without mortar and can then be mortared by pouring a thin mortar into one or more of the vertical spaces.

Said building brick is deficient in several respects: specifically, another block configuration has to be used for laying wall corners; the bricks do not allow for attaching newly built walls to existing walls; special end bricks are required to build a wall, no bonding is provided between the block side surfaces, and, finally, the system of depressions and ridges neither allows for block positioning, nor prevents block displacement along the masonry's longitudinal axis. The prior art closest to the present invention in its technical essence is a building block disclosed in GB Patent 2269606 A.

A building block comprises a rectangular parallelepiped having three pairs of opposing surfaces, each of a pair of opposing surfaces being provided with at least one of a respective one of a pair of interlocking formations. The formations on any given surface are identical. Each of said pair of interlocking formations is symmetrical about a rotation of 90°. When being assembled, two such building blocks may be arranged with one of a pair of opposing surfaces of a first of the blocks in interlocking engagement with one of any of the three pairs of opposing surfaces of the other of the blocks. Two such building blocks may be arranged with one of a pair of opposing surfaces of a first of the blocks in interlocking engagement with one of any of the three pairs of opposing surfaces of the other of the blocks.

The blocks of said type may not be connected to each other at any of their side surfaces. As such, when being assembled, these blocks require alignment in their installation positions. A specific type of the block is required to provide joints between the blocks at the structure corners. The corner blocks may not be connected to each other when being laid at the structure corners, thus requiring the wall to be joined using mortar.

SUMMARY OF THE INVENTION

It is an objective of the present invention to provide a building block which, when used for construction of a building structure, is self-alignable without any extra effort or devices, does not require mortar, enables construction of buildings and structures without the need to employ high-skill labor or mechanical aids, while reducing construction times, and obviates the need for using a specifically-shaped corner block to construct the building structure.

It is a further objective of the present invention to provide a method for assembling building blocks, which, when used for construction of a building structure, does not require mortar, enables construction of buildings and structures without the need to employ high-skill labor or mechanical aids, while reducing construction times, and obviates the need for using a specifically-shaped corner block to construct the building structure.

The above objective is accomplished by providing a building block, configured as a parallelepiped and comprising three pairs of opposing faces, including four lateral faces and two faces constituting an upper and a lower bases, each of the faces including a plurality of elements constituting projections and recesses, wherein each of the elements is shaped as a regular pyramid with rounded edges, and pyramid vertex angle between two opposing faces is within the range from 90 to 179.9 degrees, preferably from 90 to 150, more preferably from 90 to 120, and most preferably the angle is 90 degrees, the projections and recesses are arranged in rows and columns, wherein the pyramid bases at each of the parallelepiped faces are arranged in a single plane which is a face of the parallelepiped, and respective sides of the pyramid bases are parallel to the parallelepiped faces, wherein the sides of the base of a pyramid that constitutes a projection are adjacent to the respective sides of the bases of adjoining pyramids that constitute the recesses, the number of projections in the rows and columns at the parallelepiped's lateral faces being equal to the number of recesses, and their sum in the rows and columns is an even number, such that an alternate arrangement of the projections and recesses is provided in the rows and columns at the lateral faces, bases of the pyramids at the parallelepiped's upper and lower bases in the rows and columns that adjoin the sides of the upper and lower bases being spaced apart from the parallelepiped edge to form a flat region of the surface around the periphery of the parallelepiped's upper and lower bases, the rows and columns at the parallelepiped's upper and lower bases being mutually perpendicular to each other, wherein the number of projections in the rows and columns is not equal to the number of recesses, and their sum is an odd number, wherein the sum of the numbers of projections and recesses in the rows is equal to the sum of the numbers of projections and recesses in the columns, such that an alternate arrangement of projections and recesses is provided in the rows and columns at the parallelepiped bases, the building block being configured such that, when any two blocks are coupled with each other at their lateral faces, projections at a lateral face of one of the blocks are engaged with recesses at a lateral face of the other of the blocks, and, when any two blocks are coupled with each other at their bases, projections and recesses at the lower base of one of the blocks are engaged with the respective recesses and projections at the upper base of the other of the blocks, the projections and recesses at the block faces enabling coupling of four blocks, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees.

Preferably, the base of the regular pyramid is a polygon, selected from a group including a square, an octagon, and a heccaedecagon.

Preferably, the parallelepiped is equilateral and is a cube.

Further preferably, the parallelepiped is a rectangular parallelepiped.

Preferably, the building block further comprises at least one channel extending perpendicular to the parallelepiped base and designed to receive at least one item for fastening together the blocks when they are coupled to each other at the upper and lower bases, wherein the channels are isolated from each other.

Preferably, the building block further comprises at least one channel extending parallel to the parallelepiped base and designed to receive at least one item for fastening together the blocks when they are coupled to each other at the upper and lower bases, wherein the channels are isolated from each other.

Preferably, the shape of the channel section, perpendicular to its centerline, at any point along the channel centerline is selected from a group including: a circle, an oval, a square, a rectangle, a triangle or combinations thereof.

Preferably, the building block is configured as a plurality of building blocks interconnected and comprising an integral whole.

In a second embodiment, the above objective is accomplished by providing a building block configured as a parallelepiped, comprising three pairs of opposing faces, including four lateral faces and two faces constituting an upper and a lower bases, each of the faces including a plurality of elements constituting projections and recesses, wherein each of the elements is shaped as an equilateral pyramid with rounded edges, and the pyramid vertex angle between two opposing faces is within the range from 90 to 179.9 degrees, preferably from 90 to 150, more preferably from 90 to 120, and most preferably the angle is 90 degrees, the projections and recesses are arranged in rows and columns, wherein the pyramid bases at each of the parallelepiped faces are arranged in a single plane, and the respective sides of the pyramid bases are parallel to the parallelepiped faces, wherein the sides of the bases of the pyramids that constitute the projections are adjacent to the respective sides of adjoining pyramids that constitute the recesses, the rows and columns at the parallelepiped's upper and lower bases being mutually perpendicular to each other, wherein the number of projections in the rows and columns is not equal to the number of recesses and is an odd number, wherein the sum of the numbers of projections and recesses in the rows is equal to the sum of the numbers of projections and recesses in the columns, such that an alternate arrangement of projections and recesses is provided in the rows and columns at the parallelepiped bases, bases of the pyramids at the parallelepiped's lateral faces in the rows and columns that adjoin the sides of the lateral face being spaced apart from the lateral face edge to form a flat region of the surface at each of the lateral faces around its periphery, the number of projections in the rows and columns at the parallelepiped's lateral faces being equal to the number of recesses, and their sum in the rows and columns is an even number, such that an alternate arrangement of the projections and recesses is provided in the rows and columns at the lateral faces of the parallelepiped, and the building block being configured such that, when any two blocks are coupled with each other at their lateral faces, projections at a lateral face of one of the blocks are engaged with recesses at a lateral face of the other of the blocks, and, when any two blocks are coupled with each other at their bases, projections and recesses at the lower base of one of the blocks are engaged with the respective recesses and projections at the upper base of the other of the blocks, the projections and recesses at the block faces enabling coupling of is four blocks, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees Preferably, the parallelepiped's edges are chamfered.

Preferably, the base of the regular pyramid is a polygon, selected from a group including a square, an octagon, and a heccaedecagon.

Preferably, the parallelepiped is equilateral and is a cube.

Preferably, the parallelepiped is a rectangular parallelepiped.

Preferably, the building block further comprises at least one channel extending perpendicular to the parallelepiped base and designed to receive at least one item for fastening together the blocks when they are coupled to each other at the upper and lower bases, wherein the channels are isolated from each other.

Preferably, the building block further comprises one or more channels extending parallel to the parallelepiped base and designed to receive at least one item for fastening together the blocks when they are coupled to each other at their lateral faces.

Preferably, the shape of the channel section, perpendicular to its centerline, at any point along the channel centerline is selected from a group including: a circle, an oval, a square, a rectangle, a triangle or combinations thereof.

Preferably, the building block is configured as a plurality of building blocks interconnected and comprising an integral whole.

The above objective is further accomplished by providing a method for assembling the building blocks of claim 1, comprising:

installing a first course of the blocks onto a foundation, wherein a first, a second and further blocks are installed onto the foundation one by one; coupling, in the course of installation, a lateral face of each of the further blocks in a horizontal course with a lateral face of the preceding block, the projections of the block that is being installed being engaged with the recesses in the preceding block in the course, with zero clearance and maintaining the upper and lower bases of the block being installed in the same orientation as the equivalent bases of the already installed blocks: installing, in the process of formation of a second and further courses, one by one a first, a second and further blocks over the blocks in the preceding course; coupling, in the course of installation, a lateral face of each of the further blocks in a horizontal course with a lateral face of the preceding block, the projections of the block that is being installed being engaged with the recesses in the preceding block in the course; and coupling the projections and recesses at the lower base of a block in a further course with the respective recesses and projections at the upper base of a block in the preceding course; coupling four blocks, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees The above objective is further accomplished by providing a method for assembling the building blocks of claim 5 or 6, comprising: installing a first course of blocks onto a foundation having embedded items extending perpendicular to the foundation and designed to be disposed in channels within the blocks to be connected and to connect the blocks to each other in a vertical course, to which end a connecting item is run through a vertical channel in a first block; installing, one by one, a second and further blocks onto the foundation; coupling, in the course of installation, a lateral face of each of the further blocks in a horizontal course with a face of a preceding block, the projections of the block that is being installed being engaged with the recesses in the preceding block in the course, with zero clearance and maintaining the upper and lower bases of the block being installed in the same orientation as the equivalent bases of the already installed blocks, the connecting items, fastened in the foundation, being disposed in the channels in the blocks being installed, and attaching the blocks to each other; installing, in the process of formation of a second and further courses, one by one a first, a second and further blocks over the blocks in the preceding course; coupling, in the course of installation, a lateral face of each of the further blocks in a horizontal course with a lateral face of the preceding block, the projections of the block that is being installed being engaged with the recesses in the preceding block in the course; and coupling the projections and recesses at the lower base of a block in a further course with the respective recesses and projections at the upper base of a block in the preceding course; coupling the connecting items fastened in the channels of a preceding course with the connecting items disposed in the respective channels in the blocks being connected; coupling four blocks, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees Preferably, completion of the assembly of each course of blocks includes disposing of items for connecting the blocks in horizontal channels in at least an even-numbered or an odd-numbered course of blocks.

In a third embodiment, the above objective is accomplished by providing a building block configured as a parallelepiped, comprising three pairs of opposing faces, including four lateral faces and two faces constituting an upper and a lower bases, at least one of the lateral faces or at least one of the base faces including a plurality of elements constituting projections and recesses, wherein each of the elements is shaped as a regular pyramid with rounded edges, and the pyramid vertex angle between two opposing faces is within the range from 90 to 179.9 degrees, preferably from 90 to 150, more preferably from 90 to 120, and most preferably the angle is 90 degrees, the projections and recesses are arranged in rows and columns, wherein the pyramid bases are arranged in a single plane which is a face of the parallelepiped, and the respective sides of the pyramid bases are parallel to the parallelepiped faces, wherein the sides of the base of a pyramid that constitutes a projection are adjacent to the respective sides of the bases of adjoining pyramids that constitute the recesses, at least one of the lateral faces including a surface that replicates a construction material texture, the rows and columns at said at least one base of the parallelepiped being perpendicular to each other, wherein the number of projections in the rows and columns is not equal to the number of recesses, and their sum is an odd number, wherein the sum of the numbers of projections and recesses in the rows is equal to the sum of the numbers of projections and recesses in the columns, such that an alternate arrangement of projections and recesses is provided in the rows and columns at the parallelepiped bases, the building block being configured such that, when any two blocks are coupled with each other at their lateral faces, projections at a lateral face of one of the blocks are engaged with recesses at a lateral face of the other of the blocks, and, when any two blocks are coupled with each other at their bases, projections and recesses at the lower base of one of the blocks are engaged with the respective recesses and projections at the upper base of the other of the blocks.

Preferably, at least one base face includes a surface that replicates a construction material texture.

The technical result achieved with the above design of the claimed block is that, instead of using mortar, bonding may be provided via interlocking building blocks with additional mechanical interconnection of the building blocks, where necessary, thus obviating the need for costly cement-concrete mortar manufacture, delivery and application processes, enabling construction of buildings and structures without employing high-skill labor or mechanical aids, while reducing durations of construction buildings and structures and improving productivity and quality of walling.

The above technical result is achieved by walling with the use of multifaceted blocks having projections and recesses, the blocks being coupled to each other such that a geometric interlocking of surfaces at the faces of projections on and recesses in one of the blocks with complementary surfaces at the other block projections and recesses' surfaces is provided to produce a zero-clearance interlocking of the blocks. Axes of the convergence centers of the projections and recesses in the blocks being coupled are aligned in pairs to produce a joint common for each pair; the blocks are laid one by one in one of the directions of their coupling with respect to the walling centerline, added without displacement, and connected in series.

BRIEF DESCRIPTION OF THE DRAWINGS

The essence of the present invention will become apparent from the drawings and detailed description of preferred embodiments with reference to the accompanying drawings, where.

DESCRIPTION OF PREFERRED EMBODIMENTS

Figure 1:
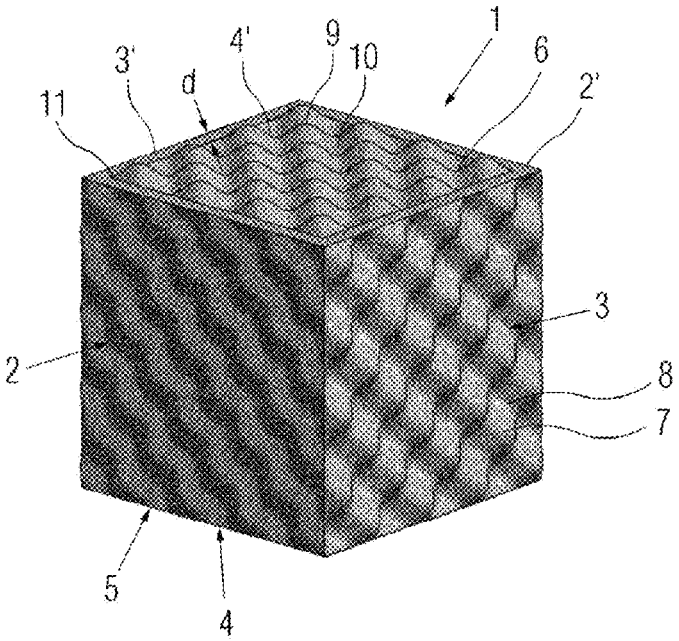
FIG. 1 is a general view of a building block in a first embodiment, wherein the building block is a cube, according to the present invention.

According to the present invention, there is provided a building block 1 (FIG. 1) configured as a parallelepiped. Hereinafter, a cube as a particular case of a parallelepiped will be described in accordance with a first embodiment of the present invention. A building block 1 comprises three pairs of opposing faces 2, 3, 4, including four lateral faces 2, 2', 3, 3' and two faces 4, 4' constituting an upper and a lower bases 5, 6 of the block 1. Each of the faces 2, 3, 4 comprises a plurality of elements 7, 8 constituting projections 9 and recesses 10. Each of the elements 7, 8 (FIG. 2) is configured as an equilateral pyramid with rounded edges, and pyramid vertex angle $\alpha$ between two opposing faces is within the range from 90 to 179.9 degrees, preferably from 90 to 150, more preferably from 90 to 120. In the most preferred embodiment said angle is 90 degrees. Shape of the projections 9 follow the shape of the recesses 10.

Projections 9 and recesses 10 (FIG. 1) are arranged in the rows and columns, wherein the pyramid bases at each of the cube faces 2, 3, 4 are arranged in a single plane, and the respective sides a, b (FIG. 2) of the pyramid bases are parallel to the cube faces, wherein the sides of the base of a pyramid that constitutes a projection 9 are adjacent to the respective sides of adjoining pyramids that constitute the recesses 10.

At the cube 1 lateral faces 2, 3 (FIG. 1), the number of projections 9 in the rows and columns is equal to the number of recesses 10 and is an even number, such that an alternate arrangement of the projections and recesses is provided in the rows and columns at all of the lateral faces.

At the cube upper and lower bases 5, 6, bases of the pyramids in the rows and columns adjoining the sides of the upper and lower bases are spaced at the distance d from the cube edge, which is equal, for example, to half the length of the pyramid base side, to form a flat region 11 at the surface around the periphery of the upper and lower bases 5, 6 of the building block 1.

The rows and columns at the cube's upper and lower bases 5, 6 are mutually perpendicular to each other, wherein the number of projections 9 in the rows and columns is not equal to the number of recesses 10 and is an odd number, wherein the sum of the numbers of projections and recesses in the rows is equal to the sum of the numbers of projections and recesses in the columns, such that an alternate arrangement of projections and recesses is provided in the rows and columns at the bases of the building block. The building block 1 is configured such that, when any two blocks are coupled with each other at their lateral faces, projections at a lateral face of one of the blocks are engaged with recesses at a lateral face of the other of the blocks, and, when any two blocks are coupled with each other at their bases, projections and recesses at the lower base of one of the blocks are engaged with the respective recesses and projections at the upper base of the other of the blocks.

Figure 2:
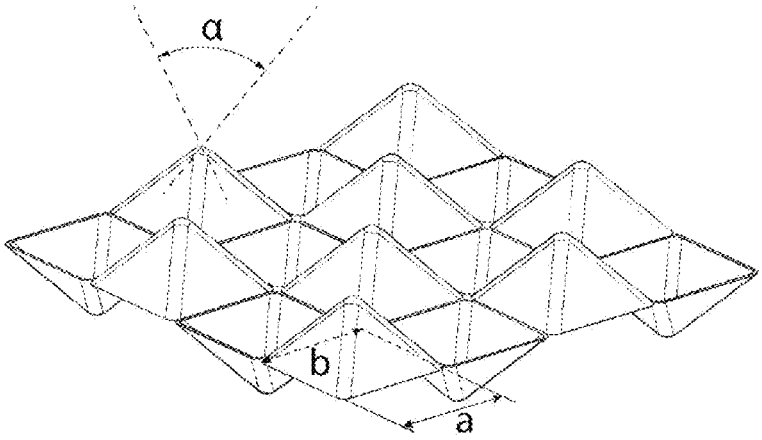
FIG. 2 is a schematic general view of a building block lateral face (broken-out sectional view), showing the angle $\alpha$ between the pyramid faces.

The projections and recesses at the block faces enable coupling of four blocks, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees The base of the regular pyramid is a polygon, selected from a group including a square, an octogon, and a heccaedecagon. FIG. 2 shows a square-based pyramid.

Figure 3:
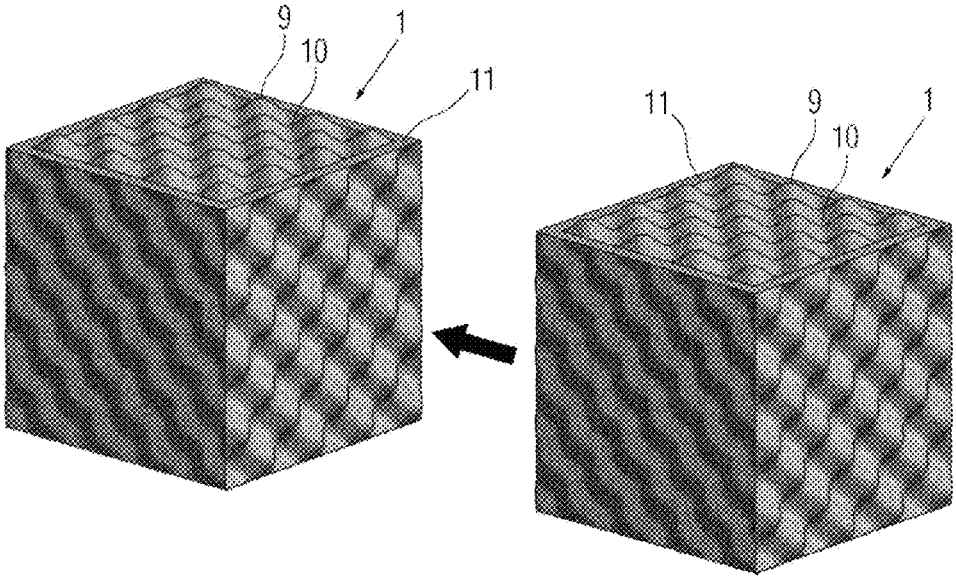
FIG. 3 is a building block assembling diagram, according to the present invention.

FIGS. 1 and 3 show a building block 1, wherein the parallelepiped is equilateral and is a cube.

Figure 4:
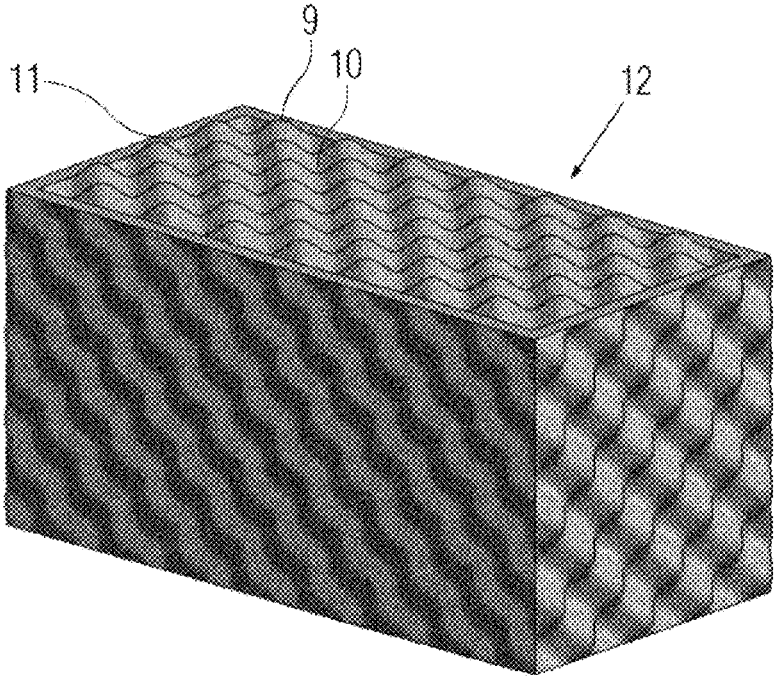
FIG. 4 shows an embodiment wherein the parallelepiped is a rectangular parallelepiped.

In one possible embodiment, the parallelepiped is a rectangular parallelepiped 12 (FIG. 4), wherein the number of projections 9 in the rows and columns at the lateral faces is equal to the number of recesses 10 and is an even number, such that an alternate arrangement of the projections and recesses is provided in the rows and columns at all of the lateral faces.

Figure 5A:
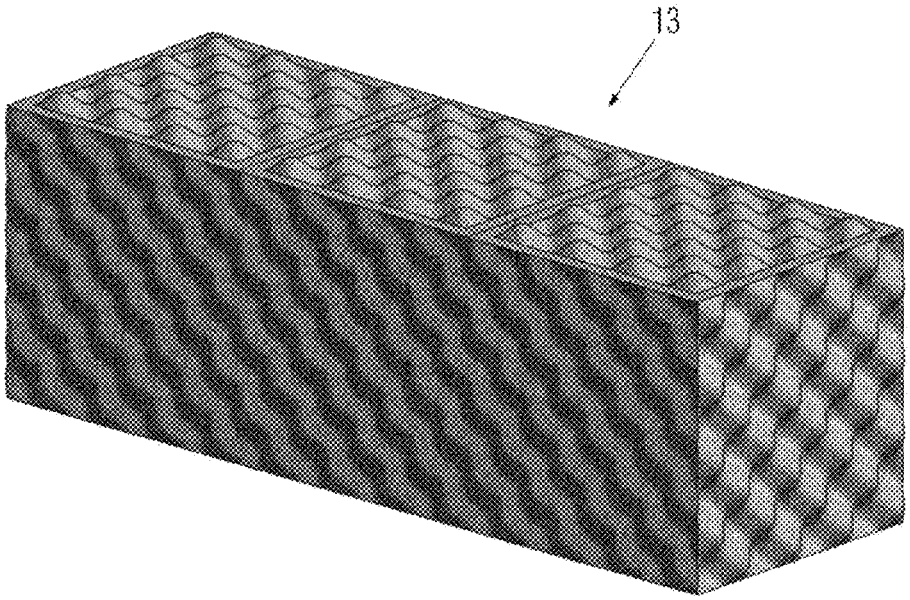
FIG. 5 shows embodiments of a building block as a plurality of cubes or parallelepipeds, or a combination thereof, interconnected and comprising an integral whole, according to the present invention.
Figure 5B:
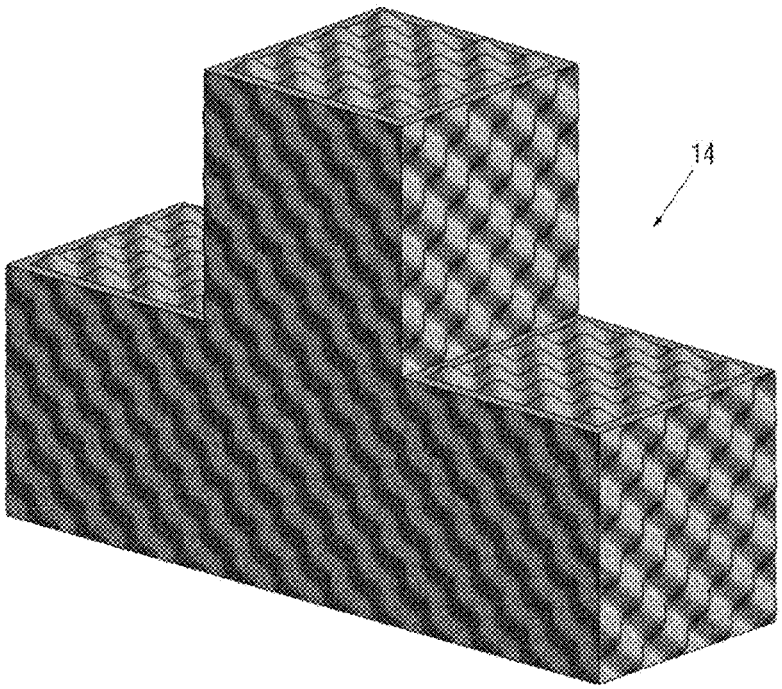
Figure 5C:
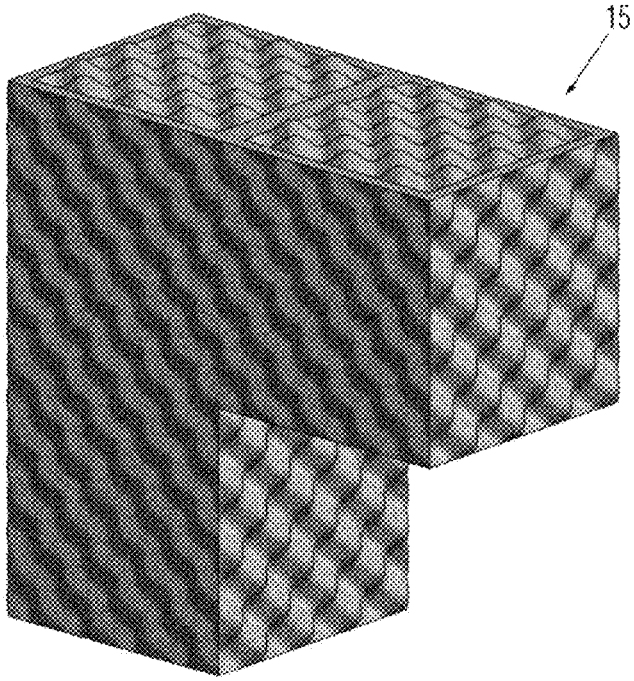

The building block may be configured as a plurality of cubes or parallelepipeds, or a combination thereof, interconnected and comprising an integral whole. FIGS. 5A, 5B, 5C show alternative interconnections of the cubes and/or parallelepipeds, rigidly interconnected and comprising an integral whole. FIG. 5A shows a building block 13 as an elongate parallelepiped. The cubes may be interconnected to form a T-shaped structure 14 (FIG. 5B) or an L-shaped structure 15 (FIG. 5C) composed by combining a rectangular parallelepiped and a cube.

Figure 6:
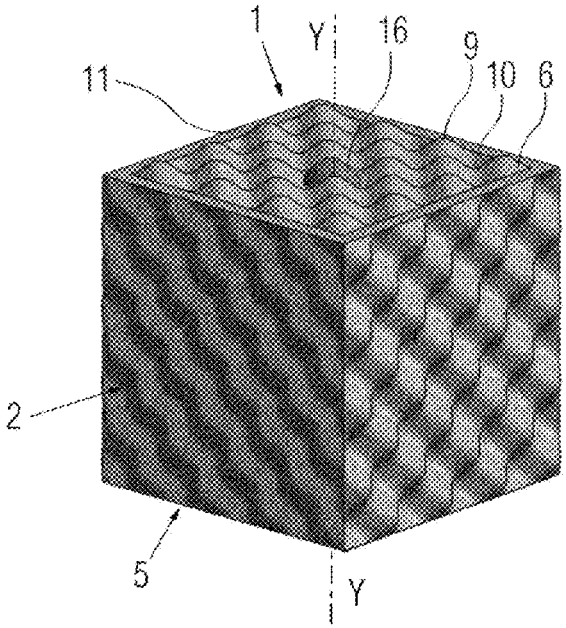
FIG. 6 is a general view of a building block, where the building block further comprises a channel extending perpendicular to a base of the block or a channel extending parallel to a base of the block, according to the present invention.

In one possible embodiment, a building block further comprises one channel 16 (FIG. 6) extending perpendicular to the base 6. The channel 16 is designed to receive at least one item (not shown) for fastening together the blocks when they are coupled to each other at the upper and lower bases.

Figure 7:
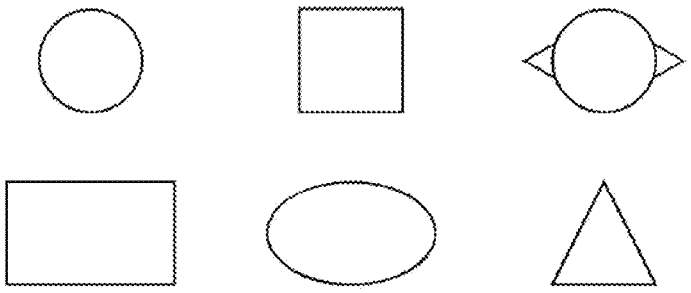
FIG. 7 shows the channels' configuration, according to the present invention.

The shape of the channel section perpendicular to the channel centerline at any point along the channel centerline is selected from a group including: a circle, an oval, a square, a rectangle, a triangle or combinations thereof (FIG. 7).

In one possible embodiment, the building block 1 further comprises multiple channels 17 extending parallel to the base and designed to receive the items 7 for fastening together the blocks when they are coupled to each other at their lateral faces, wherein the channels are isolated from each other.

Figure 8:
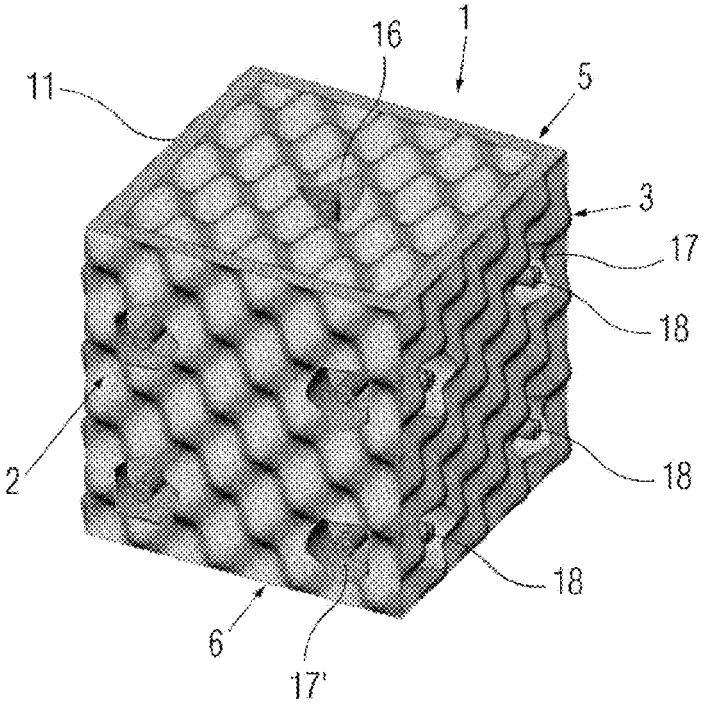
FIG. 8 is a general view of a building block, where the building block comprises four channels extending perpendicular to a base of the block and four channels extending parallel to a base of the block, according to the present invention.

FIG. 8 shows an embodiment, where the building block comprises one channel 16 extending perpendicular to the base 6, four channels 17 extending parallel to the base 6 and perpendicular to two lateral faces 3, 3', and four channels 17' extending parallel to the base 6 and perpendicular to two other lateral faces 2, 2', to receive the items for fastening together the blocks when they are coupled to each other at the upper and lower bases, the channels being isolated from each other, wherein the first four channels' centerlines are perpendicular to the other four channels' centerlines and intersect them.

Figure 9:
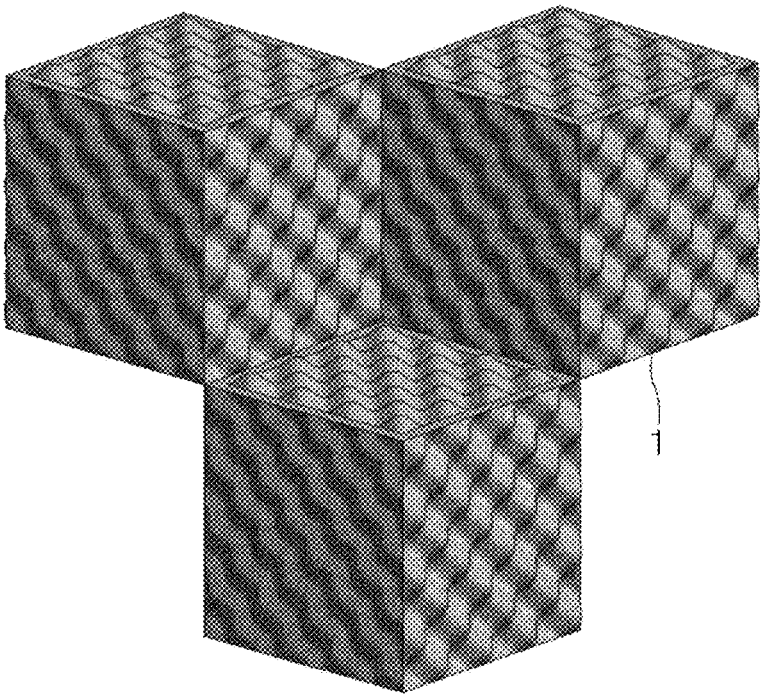
FIG. 9 shows an embodiment of corner closer block assembling, according to the present invention.

FIG. 9 shows three blocks having paired adjacent faces that are perpendicular to each other and in contact at the edges. A fourth block is coupled with said three blocks along a linear path that passes through the point of junction of the three faces, at an angle to each of said three blocks' lateral faces within the range from 45 to 89.95 angular degrees In a second embodiment, the building block 19 (FIG. 10), configured as a cube, comprises three pairs of opposing faces 20, 21, 22, including four lateral faces 20, 20', 21, 21' and two faces 22, 22' constituting an upper and a lower bases 23, 24. Each of the faces 20, 21, 22 comprises a plurality of elements 25, 26 which, similar to the elements in the first embodiment, constitute projections 27 and recesses 28, wherein each of the elements is shaped as an equilateral pyramid with rounded edges, and the pyramid vertex angle $\alpha$ between two opposing faces is within the range from 90 to 179.9 degrees preferably from 90 to 150 degrees more preferably from 90 to 120 degrees. In the most preferred embodiment, said angle is 90 degrees Projections 27 and recesses 28 are arranged in the rows and columns, similar to those in the first embodiment, wherein, at each of the cube faces, the pyramid bases a, b are arranged in a single plane, and the respective sides of the pyramid bases are parallel to the cube faces, wherein the sides of the bases of the pyramids that form projections 27 are adjacent to the respective sides of adjoining pyramids that constitute the recesses 28.

In the second embodiment, the rows and columns at the upper and the lower bases 23, 24 of the block 19 are mutually perpendicular. The number of projections 27 in the rows and columns is not equal to the number of recesses 28 and is an odd number, wherein the sum of the numbers of projections and recesses in the rows is equal to the sum of the numbers of projections and recesses in the columns, such that an alternate arrangement of projections and recesses is provided in the rows and columns at the parallelepiped bases.

In the second embodiment of the building block 19 (FIG. 10), at the lateral faces 20, 20', 21, 21', the pyramid bases in the rows and columns adjoining the sides of a lateral face are spaced, for example, at the distance 2*d* from the lateral face edge, which is equal to the pyramid base length, to form a flat region 29 of the surface at each of the lateral faces around its periphery.

Figure 11:
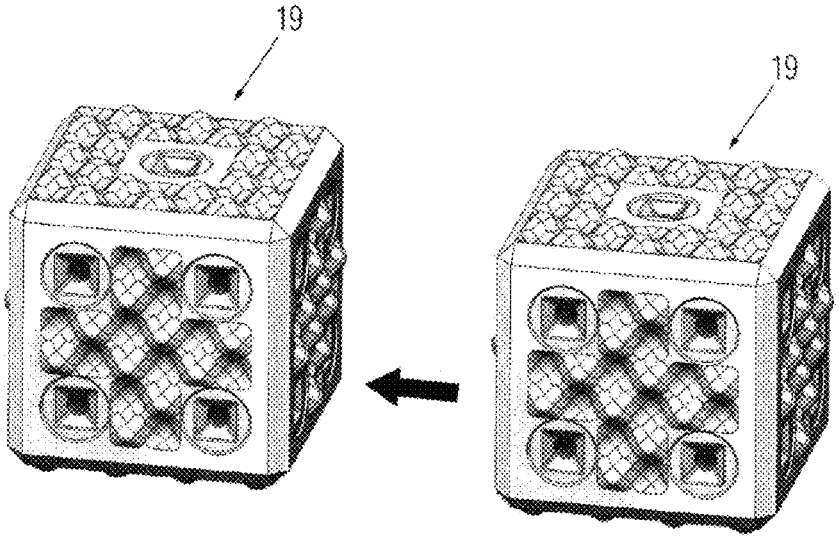
FIG. 11 is a diagram of assembling the building blocks according to the second embodiment of the present invention.

At the lateral faces 20, 21, the number of projections 27 in the rows and columns is equal to the number of recesses 28 and their sum in the rows and columns is an even number, such that an alternate arrangement of the projections and recesses is provided in the rows and columns at the lateral faces of the parallelepiped (FIG. 11).

When any two blocks are coupled with each other at their lateral faces, projections 27 at a lateral face of one of the blocks are engaged in the recesses 28 at a lateral face of the neighboring block, and, when any two blocks are coupled with each other at their bases, projections and recesses at the lower base of one of the blocks are engaged with the respective recesses and projections at the upper base of the other of the blocks.

Figure 10:
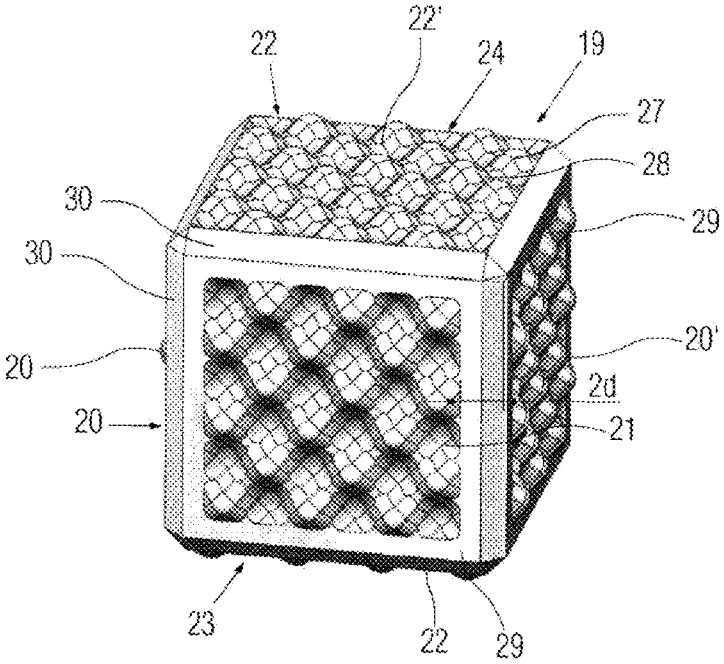
FIG. 10 is a general view of a building block in a second embodiment, wherein the building block is a cube, according to the present invention.

Projections and recesses at the block faces enable coupling of four blocks, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees In the described embodiment, the edges of the block 19 are configured with chamfers 30 (FIG. 10).

The base of the regular pyramid is a polygon, selected from a group including a square, an octogon, and a heccaedecagon. FIG. 2 shows a square-based pyramid.

FIGS. 10, 11 show the building blocks 19, wherein the parallelepiped is equilateral and is a cube.

Figure 12:
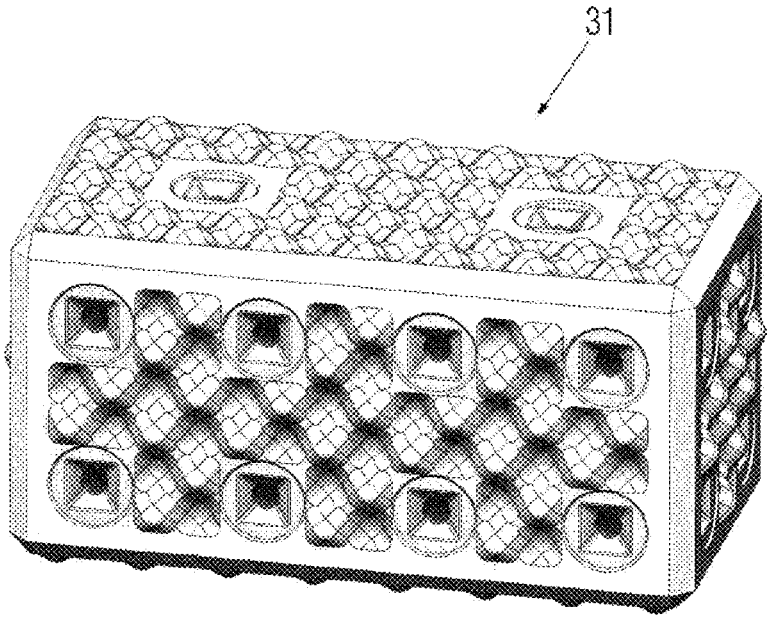
FIG. 12 shows an embodiment wherein the block is configured as a rectangular parallelepiped.

In one possible embodiment, the parallelepiped is a rectangular parallelepiped 31 (FIG. 12), wherein the number of projections 27 in the rows and columns is equal to the number of recesses 28 and is an even number, such that an alternate arrangement of the projections and recesses is provided in the rows and columns at all of the lateral faces 20, 21, wherein the sum of the numbers of projections and recesses in the rows is equal to the sum of the numbers of projections and recesses in the columns, such that an alternate arrangement of projections and recesses is provided in the rows and columns at the parallelepiped bases.

Figure 13A:
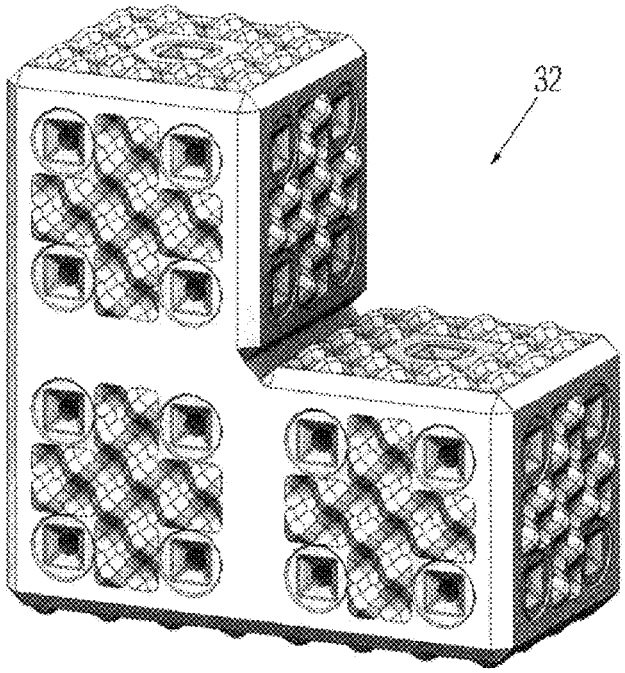
FIG. 13 shows embodiments of a building block as a plurality of cubes or parallelepipeds, or a combination thereof, interconnected and comprising an integral whole, according to the present invention.
Figure 13B:
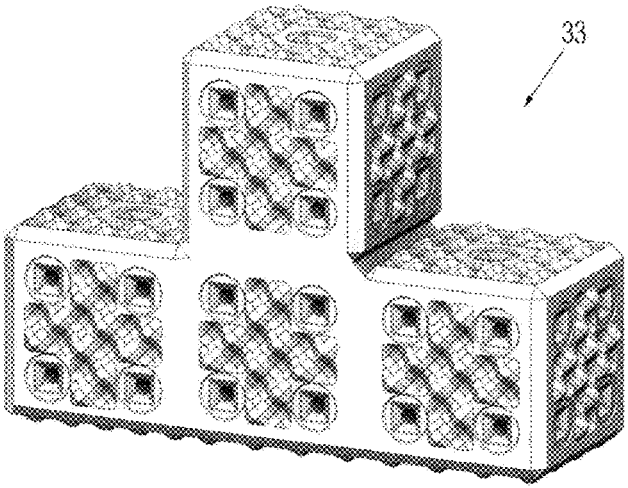
Figure 13C:
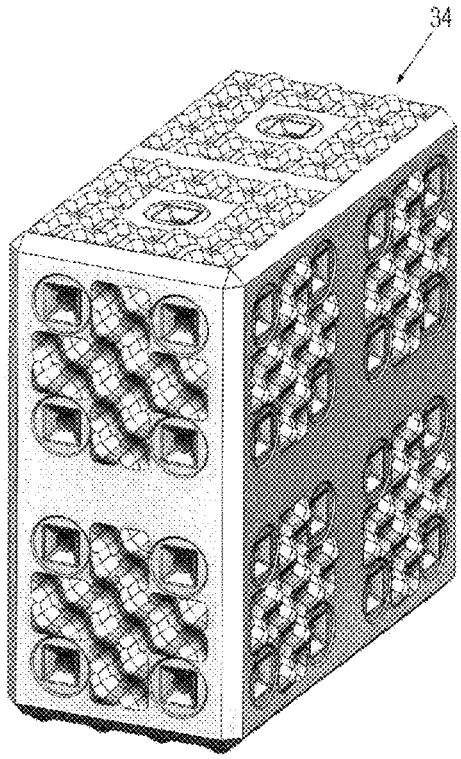

Similar to the first embodiment, the building block 19 may be configured as a plurality of cubes, or parallelepipeds, or a combination thereof. FIGS. 13A, 13B, 13C show alternative interconnections of the cubes and/or parallelepipeds, rigidly interconnected and comprising an integral whole. FIG. 13A shows an L-shaped building block 32. The cubes may be interconnected to form a T-shaped structure 33 (FIG. 13B). FIG. 13C shows a building block 34, comprised of four cubes interconnected and comprising an integral whole.

Figure 14:
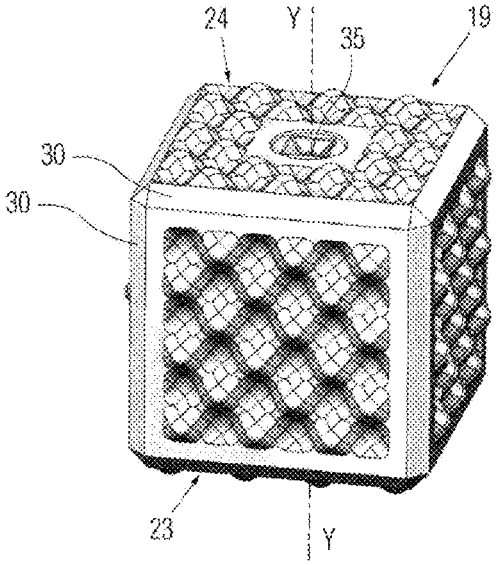
FIG. 14 is a general view of a building block, where the building block further comprises a channel extending perpendicular to a base of the block or a channel extending parallel to a base of the block, according to the present invention.

In one possible embodiment, a building block 19 further comprises a channel 35 (FIG. 14) extending perpendicular to a base 23 and designed to receive at least one item for fastening together the blocks 19 when they are coupled to each other at the upper and lower bases.

The shape of the channel 35 section is similar to the shape of the channel 16 section in the first embodiment shown in FIG. 7.

In one possible embodiment, a building block 19 further comprises one channel 36 extending perpendicular to a base 23 and designed to receive an item for fastening together the blocks 19 when they are coupled to each other at the upper and lower bases, wherein the channels are isolated from each other.

In one possible embodiment, a building block 19 further comprises multiple channels 36 extending parallel to a base and designed to receive items for fastening together the blocks when they are coupled to each other at their lateral faces, wherein the channels are isolated from each other.

Figure 15:
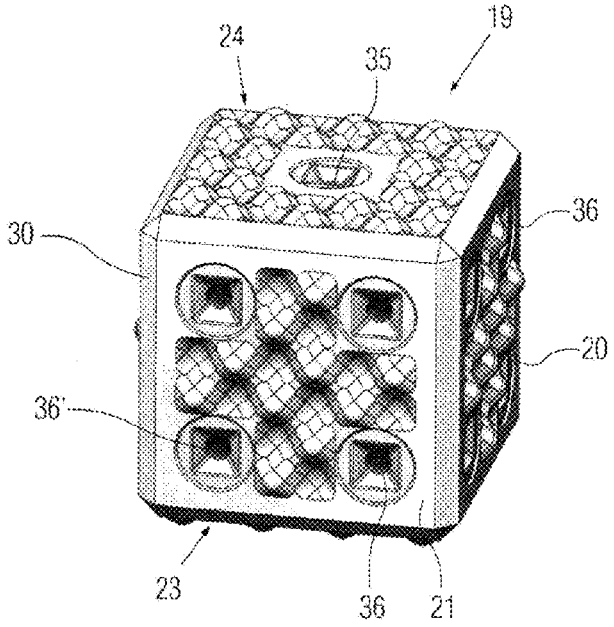
FIG. 15 is a general view of a building block, where the building block comprises four channels extending perpendicular to a base of the block and four channels extending parallel to a base of the block, according to the present invention.
Figure 16:
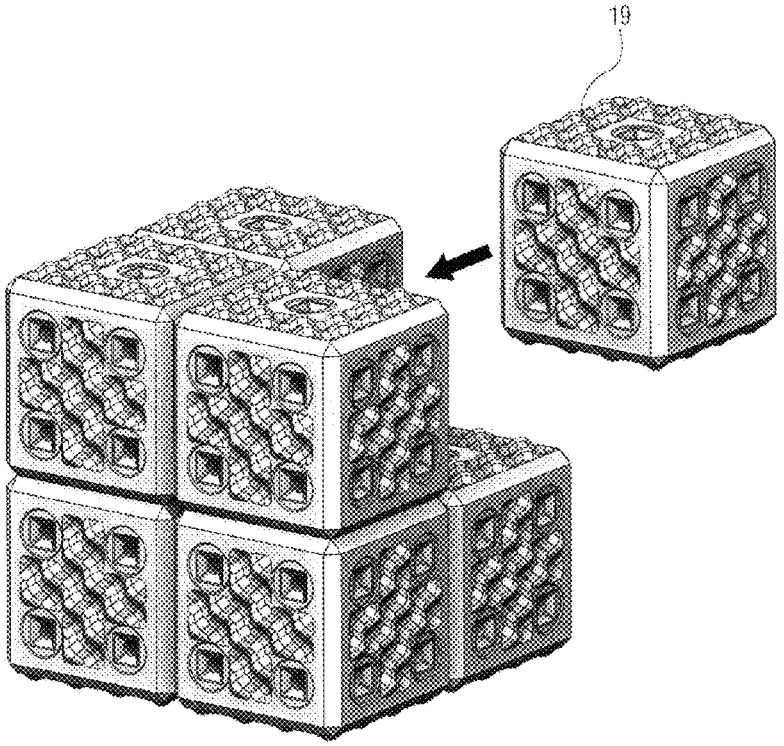
FIG. 16 shows an embodiment of assembling a structure with the use of connecting items, according to the present invention.

FIG. 15 shows an embodiment, where a building block 19 comprises one channel 35 extending perpendicular to a base 23, four channels 36 extending parallel to the base 23 and perpendicular to two lateral faces 20, 20', and four channels 36' extending parallel to the base 23 and perpendicular to two other lateral faces 21, 21', to receive items for fastening together the blocks when they are coupled to each other at the upper and lower bases, the channels being isolated from each other, wherein the first four channels' centerlines are perpendicular to the other four channels' centerlines and intersect them.

A structure is assembled as follows.

A method for assembling building blocks according to the first embodiment of the present invention comprises the following steps.

A first course of blocks is installed onto a foundation, to which end a first, a second and further blocks 1 (FIG. 17) are installed one by one on the foundation 37; coupling, in the course of installation, a lateral face of each of the further blocks 1 in a horizontal course with a lateral face of the preceding block, the projections of the block that is being installed being engaged with the recesses in the preceding block in the course, with zero clearance and maintaining the upper and lower bases 4 of the block being installed in the same orientation as the equivalent bases 4 of the already installed blocks.

In the process of formation of a second and further courses, a first, a second and further blocks are installed one by one over the blocks in the preceding course; in the course of installation, a lateral face of each of the further blocks in a horizontal course is coupled with a lateral face of the preceding block, the projections of the block that is being installed being engaged with the recesses in the preceding block in the course.

As noted above, the building block is configured such that when any two blocks are coupled with each other at their bases, projections and recesses at a lower base of a block in a further course are engaged with the respective recesses and projections at an upper base of a block in a preceding, course.

Each course of blocks is installed such that the block closing, in the horizontal course being formed, two walls adjoining at the angle of 90 degrees is a corner block.

By installing the block into the corner position between the blocks of said two adjoining walls, coupling of four blocks is provided, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees A method for assembling building blocks according to the second embodiment of the present invention is implemented as follows.

A first block 19 is disposed on a pre-built foundation 37 (FIG. 18), having items 18 embedded therein, extending perpendicular to the foundation 37 and designed to be disposed, if necessary, in channels 35 of the blocks 19, 32, 33, 34 being assembled and to fasten said blocks as part of assembling thereof, the first block 19 being disposed such that the connecting items 18 pass through the channels 35 in the blocks 19. A further block 19 is installed with its base 23 face on the foundation 37, and the lateral faces are coupled at the axes of the convergence centers of the projections 27 and recesses 28 in the blocks 19 being joined.

Projections 27 are engaged in the recesses 28 at the lateral faces 20 and 21, thus enabling interconnection of the blocks 19 with zero clearance. The blocks 19 are installed with respect to the walling center longitudinal axis in one of the directions of their coupling, added without displacement, and connected in series. Where required, connecting items 18 are disposed in the channel 35 in the block 19 being joined.

In one possible embodiment, the blocks 19 are installed in two parallel courses, the projections being engaged in the recesses at the lateral faces 20, 21, thus providing for the blocks 19 to be also connected with zero clearance, while preventing, in both the first and is the second cases of connection, the blocks from displacement with respect to each other along the axes X and Y.

Figure 18:
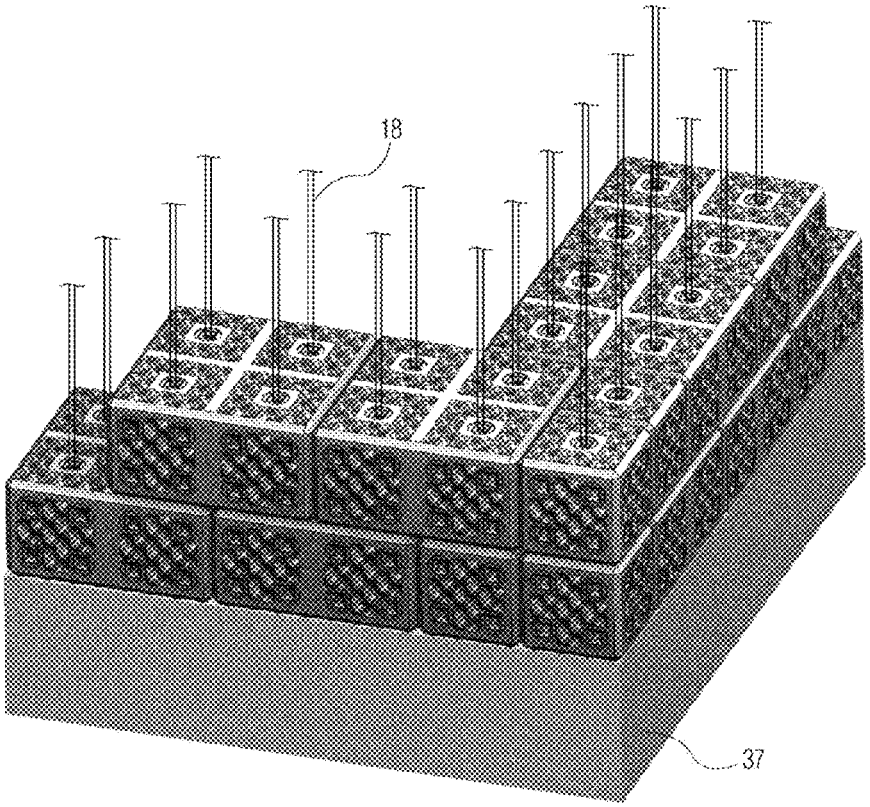
FIG. 18 shows an embodiment of assembling a structure over a foundation with the use of connecting items, according to the present invention.

The connecting surfaces comprising a plurality of elements constituting projections and recesses allow for the blocks to be interconnected, when added in either horizontal, or vertical directions. The blocks to be interconnected are disposed such that the surfaces to be connected are facing each other, following which the surfaces are coupled such as to match the projections and recesses on the surfaces to be connected, as well as the channels for connecting items. Where required, a block may be rotated about the vertical axis by 90 degrees FIG. 18 shows mutually fastened horizontal blocks. Where the elements are brought into contact with each other, they become mutually fastened in the vertical direction; however, they still may be decoupled from each other by forcefully shifting the block in the horizontal direction, if no fixing member is in place. To prevent this, the blocks may be fixed with a fixing member, as shown in FIG. 18. To maintain engagement, a fixing member (not shown) is installed onto the blocks lateral portion. The fixing member may connect blocks in pairs. In one possible embodiment, one fixing member 18 extends throughout all of the blocks 19 along the structure length via the channels 36 extending along the axis X. The blocks may not be decoupled, unless the fixing member is removed.

By installing the block 19 into the corner position between the blocks of said two adjoining walls, coupling of four blocks is provided, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees The blocks are fixed to each other by installing a connecting item in a channel for connecting items, following which the blocks become fixed.

Figure 17:
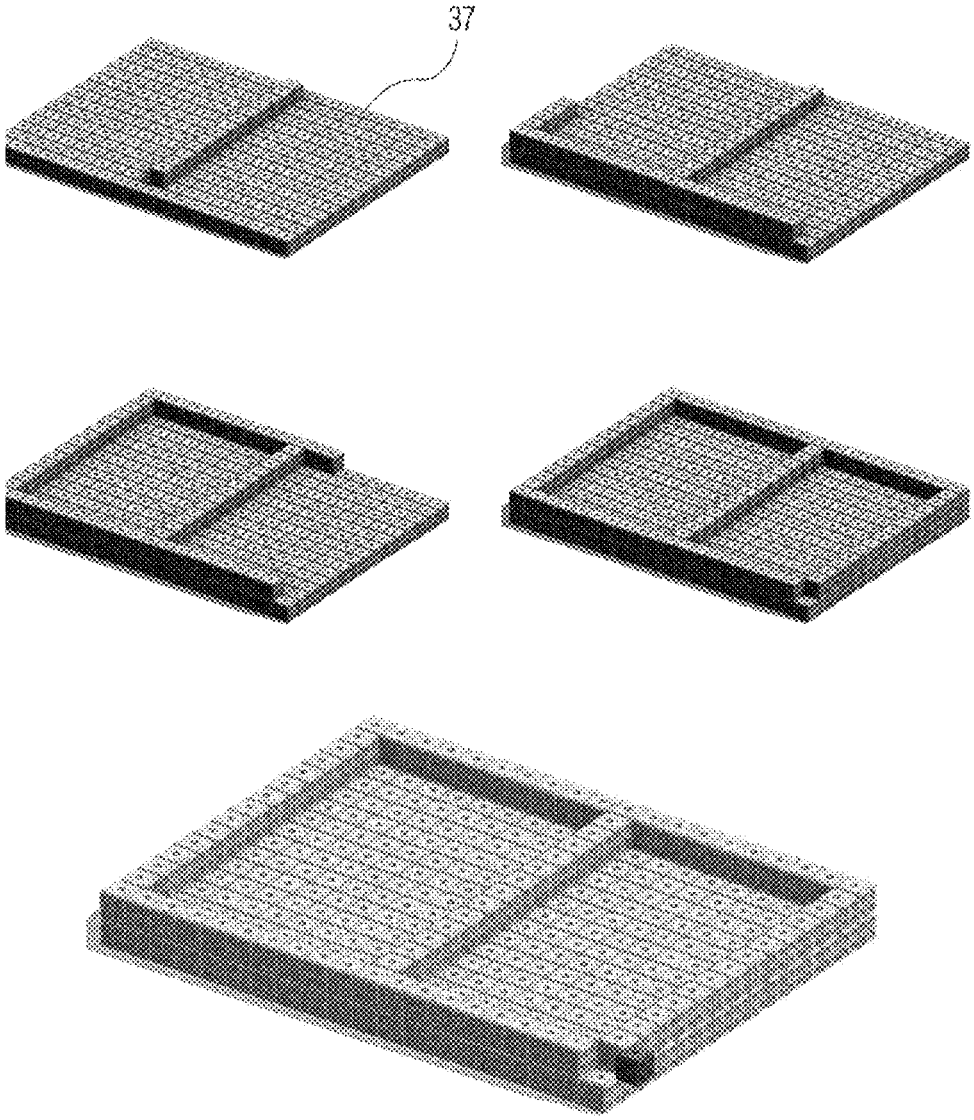
FIG. 17 is a an assembly diagram for a first course of a structure comprising an inner wall, where the first course of blocks is a foundation.

It should be noted, that no special foundation is required to assemble a building structure. The foundation may be an assembly comprised of blocks constituting a foundation, as shown in FIG. 17. Therein, the blocks are attached to the foundation via connecting items (not shown) which interconnect the blocks both in the horizontal and vertical directions.

Figure 19:
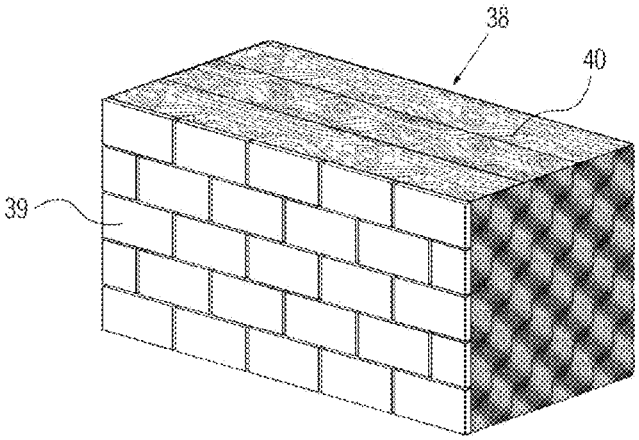
FIG. 19 is a general view of a building block, wherein one lateral face and one base face include a surface replicating a construction material texture.

In another embodiment of a building block 38, shown in FIG. 19, for example, one lateral face 39 and one base face 40 include a surface replicating a construction material texture. In the described embodiment, the building block lateral face 39 surface replicates brickwork or wood texture, while the upper base 40 replicates a wood texture. As such, where one of the building block 38 lateral faces is intended to form an exterior wall of a structure to be built, an impression may be given, following painting in appropriate color, that such exterior wall is laid of bricks or made of wood.

INDUSTRIAL APPLICABILITY

With the present invention, bonding may be provided without mortar, only via interlocking building blocks and with additional mechanical interconnection of the building blocks, where necessary, thus obviating the need for costly cement-concrete mortar manufacture, delivery and application processes, enabling construction of buildings and structures without employing high-skill labor or mechanical aids, while reducing durations of construction of buildings and structures and improving productivity and quality of walling. No special corner block is required to assemble a structure.

The invention claimed is:

1. Building block, configured as a parallelepiped, comprising three pairs of opposing faces, including four lateral faces and two faces constituting an upper and a lower bases, each of the faces including a plurality of elements constituting projections and recesses, wherein each of the elements is shaped as a regular pyramid with rounded edges, and the pyramid vertex angle between two opposing faces is within the range from 90 to 179.9 degrees, the projections and recesses are arranged in rows and columns, wherein the pyramid bases at each of the parallelepiped faces are arranged in a single plane which is a face of the parallelepiped, and the respective sides of the pyramid bases are parallel to the parallelepiped faces, wherein the sides of the base of a pyramid that constitutes a projection are adjacent to the respective sides of the bases of adjoining pyramids that constitute the recesses, the number of projections in the rows and columns at the parallelepiped's lateral faces being equal to the number of recesses, and their sum in the rows and columns is an even number, such that an alternate arrangement of the projections and recesses is provided in the rows and columns at the lateral faces, bases of the pyramids at the parallelepiped's upper and lower bases in the rows and columns that adjoin the sides of the upper and lower bases being spaced apart from the parallelepiped edge to form a flat region of the surface around the periphery of the parallelepiped's upper and lower bases, the rows and columns at the parallelepiped's upper and lower bases being mutually perpendicular to each other, wherein the number of projections in the rows and columns at the parallelepiped's upper and lower bases is not equal to the number of recesses, and their sum is an odd number, wherein the sum of the numbers of projections and recesses in the rows is equal to the sum of the numbers of projections and recesses in the columns, such that an alternate arrangement of projections and recesses is provided in the rows and columns at the parallelepiped bases, the building block being configured such that, when any two blocks are coupled with each other at their lateral faces, projections at a lateral face of one of the blocks are engaged with recesses at a lateral face of the other of the blocks, and, when any two blocks are coupled with each other at their bases, projections and recesses at the lower base of one of the blocks are engaged with the respective recesses and projections at the upper base of the other of the blocks, the projections and recesses at the block faces enabling coupling of four blocks, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees.

2. The building block of claim 1, wherein the base of the regular pyramid is a polygon, selected from a group including a square, an octogon, and a heccaedecagon.

3. The building block of claim 1, wherein the parallelepiped is equilateral and is a cube.

4. The building, block of claim 1, wherein parallelepiped is a rectangular parallelepiped.

5. The building block of claim 1, further comprising at least one channel extending perpendicular to the parallelepiped base and designed to receive at least one item for fastening together the blocks when they are coupled to each other at the upper and lower bases, wherein the channels are isolated from each other.

6. The building block of claim 1 or 5, further comprising at least one channel extending parallel to the parallelepiped base and perpendicular to two lateral faces, to receive the items for fastening together the blocks when they are coupled to each other at their lateral faces.

7. The building block of claim 5, wherein the shape of the channel section, perpendicular to its centerline, at any point along the channel centerline is selected from a group including: a circle, an oval, a square, a rectangle, a triangle or combinations thereof.

8. The building block of claim 6, wherein the shape of the channel section, perpendicular to its centerline, at any point along the channel centerline is selected from a group including: a circle, an oval, a square, a rectangle, a triangle or combinations thereof.

9. The building block of any of claim 3 or 4, including a plurality of building blocks, interconnected and comprising an integral whole.

10. A building block, configured as a parallelepiped, comprising: three pairs of opposing faces, including four lateral faces and two faces constituting an upper and a lower bases, each of the faces including a plurality of elements constituting projections and recesses, wherein each of the elements is shaped as an equilateral pyramid with rounded edges, and the pyramid vertex angle between two opposing faces is within the range from 90 to 179.9 degrees, the projections and recesses are arranged in rows and columns, wherein the pyramid bases at each of the parallelepiped faces are arranged in a single plane, and the respective sides of the pyramid bases are parallel to the parallelepiped faces, wherein the sides of the bases of the pyramids that constitute the projections are adjacent to the respective sides of adjoining pyramids that constitute the recesses, the rows and columns at the parallelepiped's upper and lower bases being mutually perpendicular to each other, wherein the number of projections in the rows and columns at the parallelepiped's upper and lower bases is not equal to the number of recesses and is an odd number, wherein the sum of the numbers of projections and recesses in the rows is equal to the sum of the numbers of projections and recesses in the columns, such that an alternate arrangement of projections and recesses is provided in the rows and columns at the parallelepiped bases, bases of the pyramids at the parallelepiped's lateral faces in the rows and columns that adjoin the sides of the lateral face being spaced apart from the lateral face edge, to form a flat region of the surface at each of the lateral faces around its periphery, the number of projections in the rows and columns at the parallelepiped's lateral faces being equal to the number of recesses, and their sum in the rows and columns is an even number, such that an alternate arrangement of the projections and recesses is provided in the rows and columns at the lateral faces of the parallelepiped, the building block being configured such that, when any two blocks are coupled with each other at their lateral faces, projections at a lateral face of one of the blocks are engaged with recesses at a lateral face of the other of the blocks, and, when any two blocks are coupled with each other at their bases, projections and recesses at the lower base of one of the blocks are engaged with the respective recesses and projections at the upper base of the other of the blocks, the projections and recesses at the block faces enabling coupling of four blocks, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees.

11. The building block of claim 10, wherein the parallelepiped's edges are chamfered.

12. The building block of claim 10, wherein the base of the regular pyramid is a polygon, selected from a group including a square, an octagon, and a heccaedecagon.

13. The building block of claim 10, wherein the parallelepiped is equilateral and is a cube.

14. The building block of claim 10, wherein the parallelepiped is a rectangular parallelepiped.

15. The building block of claim 10, further comprising at least one channel extending perpendicular to the parallelepiped base and designed to receive at least one item for fastening together the blocks when they are coupled to each other at the upper and lower bases, wherein the channels are isolated from each other.

16. The building block of claim 10 or 15, further comprising one or more channels extending parallel to the parallelepiped base and designed to receive at least one item for fastening together the blocks when they are coupled to each other at their lateral faces.

17. The building block of claim 15, wherein the shape of the channel section, perpendicular to its centerline, at any point along the channel centerline is selected from a group including: a circle, an oval, a square, a rectangle, a triangle or combinations thereof.

18. The building block of claim 16, wherein the shape of the channel section, perpendicular to its centerline, at any point along the channel centerline is selected from a group including: a circle, an oval, a square, a rectangle, a triangle or combinations thereof.

19. The building block of any of claim 13 or 14, including a plurality of building blocks, interconnected and comprising an integral whole.

20. A method of assembling a structure using building blocks as described in claim 1, the method comprising: installing a first course of the blocks onto a foundation, wherein a first, a second and further blocks are installed onto the foundation one by one; coupling, in the course of installation, a lateral face of each of the further blocks in a horizontal course with a lateral face of the preceding block, the projections of the block that is being installed being engaged with the recesses in the preceding block in the course, with zero clearance and maintaining the upper and lower bases of the block being installed in the same orientation as the equivalent bases of the already installed blocks; installing, in the process of formation of a second and further courses, one by one a first, a second and further blocks over the blocks in the preceding course; coupling, in the course of installation, a lateral face of each of the further blocks in a horizontal course with a lateral face of the preceding block, the projections of the block that is being installed being engaged with the recesses in the preceding block in the course; and coupling the projections and recesses at the lower base of a block in a further course with the respective recesses and projections at the upper base of a block in the preceding course; coupling four blocks, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees.

21. A method of assembling a structure using building blocks as described in claim 5 or 6, the method comprising: installing a first course of blocks onto a foundation having embedded items extending perpendicular to the foundation and designed to be disposed in channels within the blocks to be connected and to connect the blocks to each other in a vertical course, to which end a connecting item is run through a vertical channel in a first block; installing, one by one, a second and further blocks onto the foundation; coupling, in the course of installation, a lateral face of each of the further blocks in a horizontal course with a face of a preceding block, the projections of the block that is being installed being engaged with the recesses in the preceding block in the course, with zero clearance and maintaining the upper and lower bases of the block being, installed in the same orientation as the equivalent bases of the already installed blocks, the connecting items, fastened in the foundation, being disposed in the channels in the blocks being installed, and attaching the blocks to each other; installing, in the process of foil iation of a second and further courses, one by one a first, a second and further blocks over the blocks in the preceding course; coupling, in the course of installation, a lateral face of each of the further blocks in a horizontal course with a lateral face of the preceding block, the projections of the block that is being installed being engaged with the recesses in the preceding block in the course; and coupling, the projections and recesses at the lower base of a block in a further course with the respective recesses and projections at the upper base of a block in the preceding course; coupling the connecting items fastened in the channels of a preceding course with the connecting items disposed in the respective channels in the blocks being connected; coupling four blocks, three of which having paired adjacent faces that are perpendicular to each other and in contact at the edges, while a fourth block is coupled with said three blocks along a linear path that passes through the point of junction of the three faces, at an angle to each of said three blocks' lateral faces within the range from 45 to 89.95 angular degrees.

22. The method of claim 21, wherein completion of the assembly of each course of blocks includes disposing of items for connecting the blocks in horizontal channels in at least an even-numbered or an odd-numbered course of blocks.

23. A building block, configured as a parallelepiped, comprising: three pairs of opposing faces, including four lateral faces and two faces constituting an upper and a lower bases, at least one of the lateral faces or at least one of the base faces including a plurality of elements constituting projections and recesses, wherein each of the elements is shaped as a regular pyramid with rounded edges, and the pyramid vertex angle between two opposing faces is within the range from 90 to 179.9 degrees, the projections and recesses are arranged in rows and columns; wherein the pyramid bases are arranged in a single plane which is a face of the parallelepiped, and the respective sides of the pyramid bases are parallel to the parallelepiped faces; wherein the sides of the base of a pyramid that constitutes a projection are adjacent to the respective sides of the bases of adjoining pyramids that constitute the recesses, at least one of the lateral faces including a surface that replicates a construction material texture, the rows and columns at said at least one base of the parallelepiped being perpendicular to each other; wherein the number of projections in the rows and columns is not equal to the number of recesses, and their sum is an odd number; wherein the sum of the numbers of projections and recesses in the rows is equal to the sum of the numbers of projections and recesses in the columns, such that an alternate arrangement of projections and recesses is provided in the rows and columns at the parallelepiped bases, the building, block being configured such that, when any two blocks are coupled with each other at their lateral faces, projections at a lateral face of one of the blocks are engaged with recesses at a lateral face of the other of the blocks, and, when any two blocks are coupled with each other at their bases, projections and recesses at the lower base of one of the blocks are engaged with the respective recesses and projections at the upper base of the other of the blocks.

24. The building block of claim 23, wherein at least one base face includes a surface that replicates a construction material texture.

25. The building block of claim 1 wherein the pyramid vertex angle between two opposing faces is within the range from 90 to 150.

26. The building block of claim 1, wherein the pyramid vertex angle between two opposing faces is within the range from 90 to 120.

27. The building block of claim 1 wherein the pyramid vertex angle between two opposing faces is 90 degrees.

28. The building block of claim 10, wherein the pyramid vertex angle between two opposing faces is within the range from 90 to 150.

29. The building block of claim 10, wherein the pyramid vertex angle between two opposing faces is within the range from 90 to 120.

30. The building block of claim 10, wherein the pyramid vertex angle between two opposing faces is 90 degrees.

31. The building block of claim 23, wherein the pyramid vertex angle between two opposing faces is within the range from 90 to 150.

32. The building block of claim 23, wherein the pyramid vertex angle between two opposing faces is within the range from 90 to 120.

33. The building block of claim 23, wherein the pyramid vertex angle between two opposing faces is 90 degrees.

* * * * *